US012686961B2

(12) United States Patent
Wong et al.

(10) Patent No.: US 12,686,961 B2
(45) Date of Patent: Jul. 21, 2026

(54) SOUND DAMPENING ASSEMBLY FOR A WASHING MACHINE APPLIANCE

(71) Applicant: Haier US Appliance Solutions, Inc., Wilmington, DE (US)

(72) Inventors: Emily Wong, Hudson, WI (US); Heyner Loaisiga, Miami, FL (US); Charanjot Singh, Leesburg, VA (US); Cody Ewing, Floyds Knobs, IN (US); Aldo Vincent Kremmel, Palmyra, IN (US); Rabha Bitat, West Lafayette, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 132 days.

(21) Appl. No.: 18/758,464

(22) Filed: Jun. 28, 2024

(65) Prior Publication Data

US 2026/0002309 A1 Jan. 1, 2026

(51) Int. Cl.

| | |
|---|---|
| ***D06F 37/24*** | (2006.01) |
| ***D06F 23/04*** | (2006.01) |
| ***D06F 37/26*** | (2006.01) |

(52) U.S. Cl.

CPC ..... *D06F 37/24* (2013.01); *D06F 23/04* (2013.01); *D06F 37/267* (2013.01)

(58) Field of Classification Search

None

See application file for complete search history.

(56) References Cited

U.S. PATENT DOCUMENTS

| | | | | |
|---|---|---|---|---|
| 505,043 | A | 9/1893 | Glidden et al. | |
| 5,269,159 | A | 12/1993 | Oh | |
| 7,694,540 | B2 | 4/2010 | Ishida et al. | |
| 9,957,660 | B2 | 5/2018 | Kim et al. | |
| 9,963,817 | B2 | 5/2018 | McLean et al. | |
| 11,008,697 | B2 | 5/2021 | Masters | |
| 11,142,859 | B2 * | 10/2021 | Lv | D06F 37/24 |
| 2012/0096652 | A1 * | 4/2012 | Choi | D06F 23/04 68/183 |
| 2023/0212806 | A1 * | 7/2023 | Andreen | D06F 23/04 68/12.01 |

FOREIGN PATENT DOCUMENTS

| | | | |
|---|---|---|---|
| CA | 2707883 | C | 4/2013 |
| CN | 204690372 | U | 10/2015 |

(Continued)

OTHER PUBLICATIONS

KR 20010048541 A machine translation, Electric Washing Machine, Jung (Year: 2001).*

*Primary Examiner* — Cristi J Tate-Sims

(74) *Attorney, Agent, or Firm* — Dority & Manning, P.A.

(57) ABSTRACT

A washing machine appliance includes a cabinet, a wash tub positioned within the cabinet, a wash basket rotatably mounted within the wash tub and defining a wash chamber configured for receiving a load of clothes, a tub cover positioned over the wash tub, the tub cover having a main body defining a perimeter, and a sound dampening assembly operably coupled to the tub cover. The sound dampening assembly includes an extension arm that extends from the perimeter of the tub cover and a dampening pad positioned on the extension arm to absorb impacts between the tub cover and the cabinet.

18 Claims, 8 Drawing Sheets

(56) References Cited

FOREIGN PATENT DOCUMENTS

| | | | | | |
|---|---|---|---|---|---|
| CN | 112760930 | A | | 5/2021 | |
| EP | 2065506 | B1 | | 8/2010 | |
| EP | 2110474 | B1 | | 3/2015 | |
| EP | 3266924 | A1 | * | 1/2018 | ..... D06F 37/22 |
| JP | H1133276 | A | | 9/1999 | |
| JP | 5823070 | B2 | | 11/2015 | |
| KR | 19990039025 | U | | 11/1999 | |
| KR | 20090096948 | A | | 9/2009 | |
| KR | 101387472 | B1 | | 4/2014 | |
| WO | WO2015180478 | A1 | | 12/2015 | |
| WO | WO2018202549 | A1 | | 11/2018 | |

* cited by examiner

SOUND DAMPENING ASSEMBLY FOR A WASHING MACHINE APPLIANCE

FIELD OF THE INVENTION

The present subject matter relates generally to washing machine appliances, or more specifically, to sound dampening assembly for a tub cover of a washing machine appliance.

BACKGROUND OF THE INVENTION

Washing machine appliances generally include a cabinet that receives a tub for containing wash and rinse water. A wash basket is rotatably mounted within the tub. A drive assembly is coupled to the tub and configured to rotate the wash basket within the tub in order to cleanse articles within the wash basket. Upon completion of a wash cycle, a pump assembly can be used to rinse and drain soiled water to a draining system. Some washing machine appliances may also rotate the wash basket at a relatively high speed for a spin cycle to further drain or shed water from articles within the wash basket.

In general, the tub and the wash basket, sometimes referred to collectively as the subwasher, are movable relative to the cabinet of the washing machine appliance. For example, the subwasher is commonly suspended within the cabinet by one or more suspension devices that generally allow the tub to move relative to the cabinet during operation of the washing machine appliance. A significant concern during operation of washing machine appliances is out-of-balance conditions within the wash tub. For example, articles and water loaded within a wash basket may not be equally weighted about a central axis of the wash basket and wash tub. Accordingly, when the wash basket rotates, in particular during a spin cycle, the imbalance in clothing weight can cause the subwasher to contact the cabinet. Significant movement of the wash tub can, in turn, generate increased noise, vibrations, washer "walking," and/or cause excessive wear and premature failure of appliance components.

Accordingly, a washing machine appliance that is capable of absorbing or minimizing the effects of tub strikes is desirable. More specifically, a sound dampening assembly that dampens tub strikes and sound with minimal costs and part complexity would be particularly beneficial.

BRIEF DESCRIPTION OF THE INVENTION

Advantages of the invention will be set forth in part in the following description, or may be apparent from the description, or may be learned through practice of the invention.

In one exemplary embodiment, a washing machine appliance includes a cabinet, a wash tub positioned within the cabinet, a wash basket rotatably mounted within the wash tub and defining a wash chamber configured for receiving a load of clothes, a tub cover positioned over the wash tub, the tub cover having a main body defining a perimeter, and a sound dampening assembly operably coupled to the tub cover. The sound dampening assembly includes an extension arm that extends from the perimeter of the tub cover and a dampening pad positioned on the extension arm to absorb impacts between the tub cover and the cabinet.

In another exemplary embodiment, a sound dampening assembly for a tub cover of a washing machine appliance is provided. The sound dampening assembly includes an extension arm that extends from a perimeter of the tub cover and a dampening pad positioned on the extension arm to absorb impacts between the tub cover and a cabinet of the washing machine appliance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
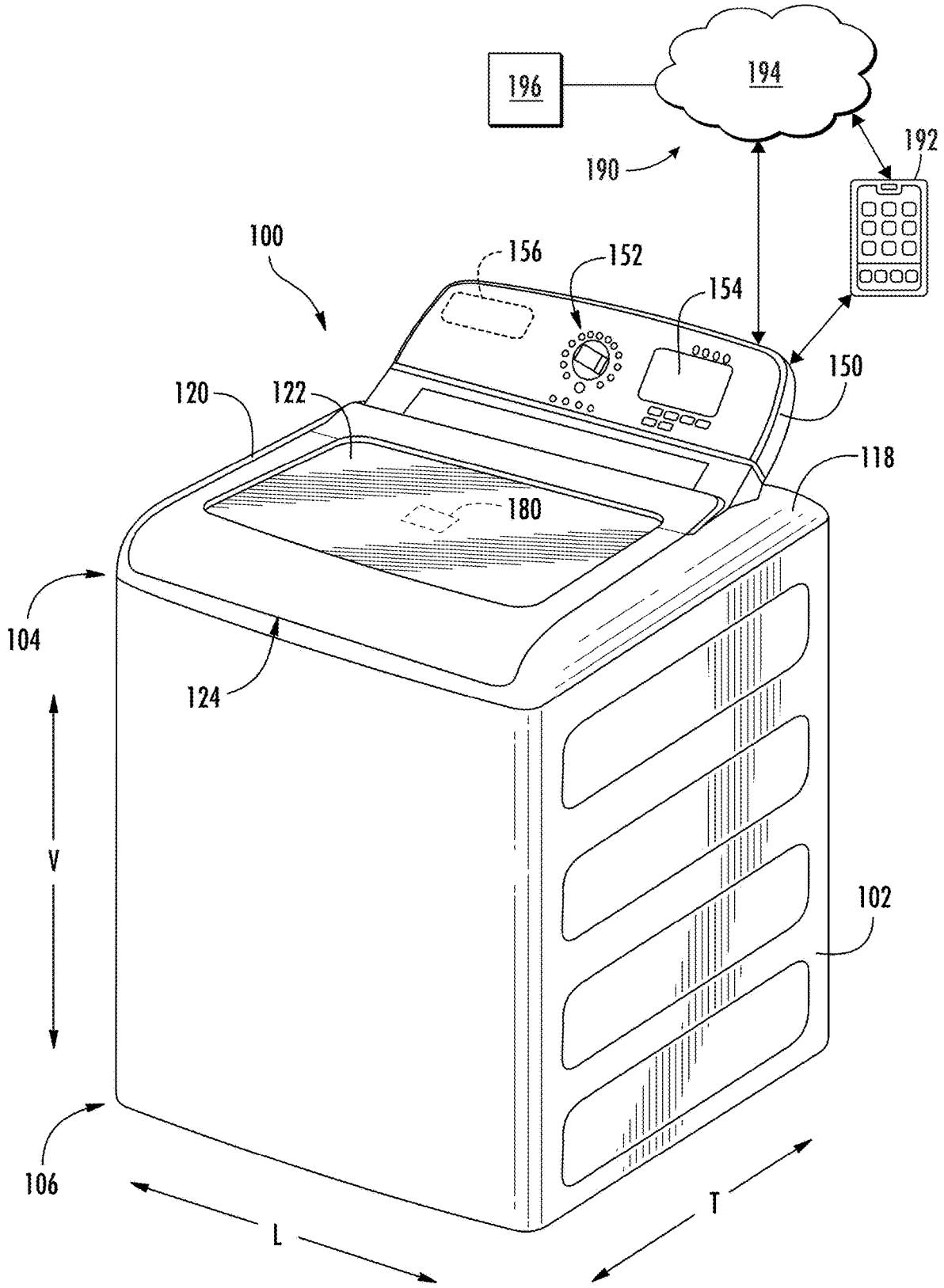
FIG. 1 provides a perspective view of a washing machine appliance according to an example embodiment of the present subject matter with a door of the example washing machine appliance shown in a closed position.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
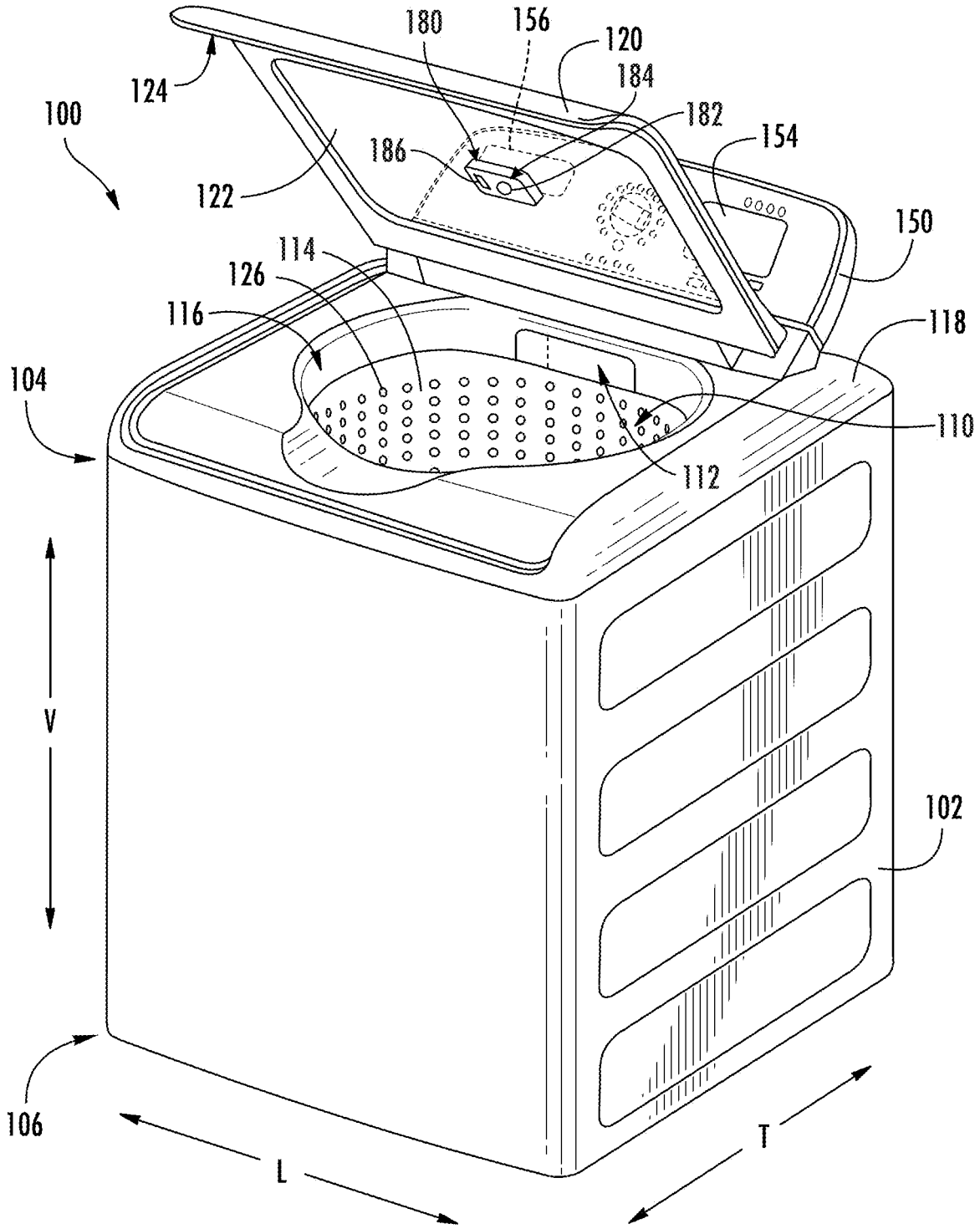
FIG. 2 provides a perspective view of the example washing machine appliance of FIG. 1 with the door of the example washing machine appliance shown in an open position.
Figure 3:
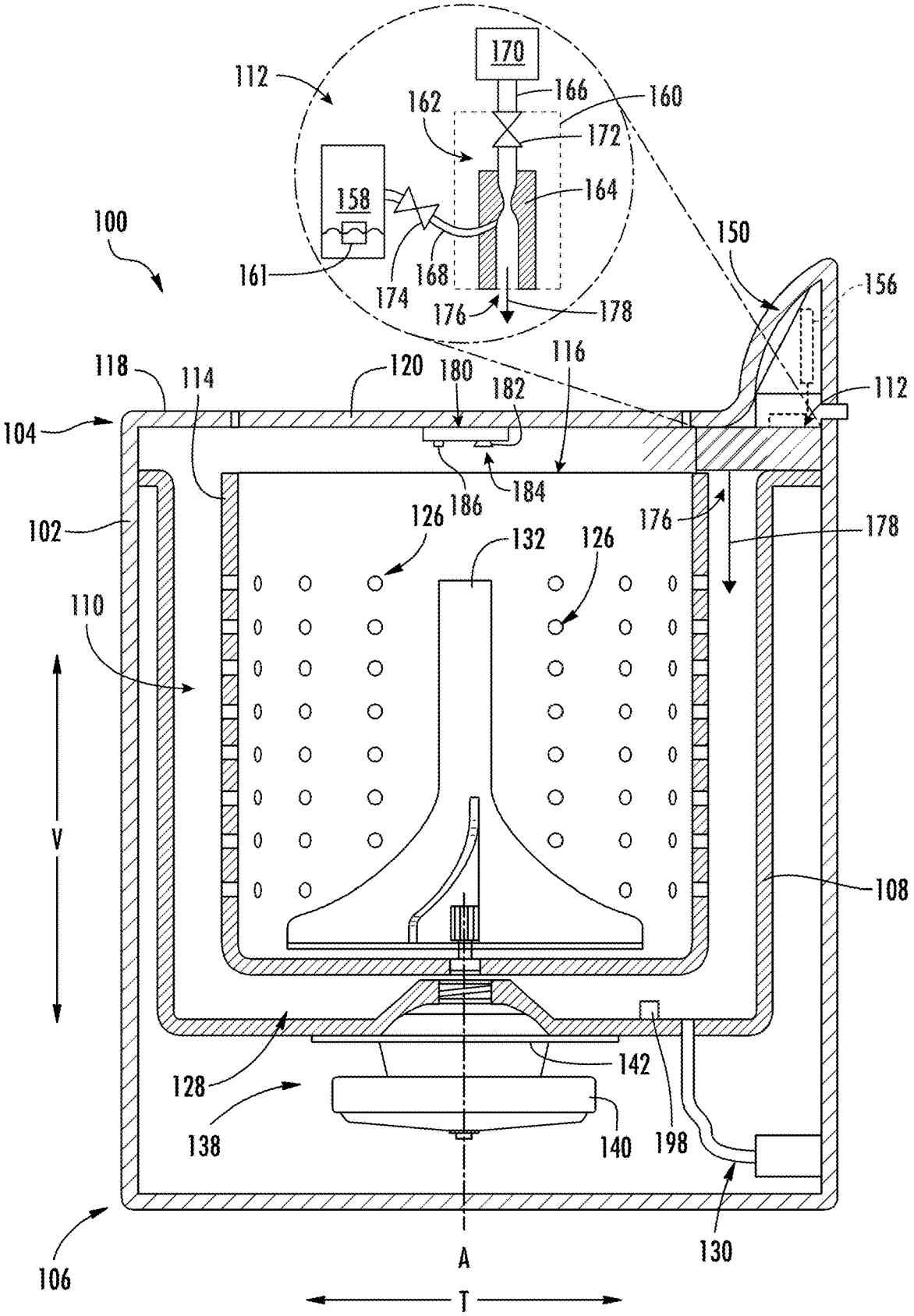
FIG. 3 provides a side cross-sectional view of the example washing machine appliance of FIG. 1.

FIGS. 1 through 3 illustrate an exemplary embodiment of a vertical axis washing machine appliance 100. Specifically, FIGS. 1 and 2 illustrate perspective views of washing machine appliance 100 in a closed and an open position, respectively. FIG. 3 provides a side cross-sectional view of washing machine appliance 100. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, it should be appreciated that vertical axis washing machine appliance 100 is provided by way of example only. It will be understood that aspects of the present subject matter may be used in any other suitable washing machine appliance, such as a horizontal axis washing machine appliance. Indeed, modifications and variations may be made to washing machine appliance 100, including different configurations, different appearances, and/or different features while remaining within the scope of the present subject matter.

Washing machine appliance 100 has a cabinet 102 that extends between a top portion 104 and a bottom portion 106 along the vertical direction V, between a first side (left) and a second side (right) along the lateral direction L, and between a front and a rear along the transverse direction T. As best shown in FIG. 3, a wash tub 108 is positioned within cabinet 102, defines a wash chamber 110, and is generally configured for retaining wash fluids during an operating cycle. Washing machine appliance 100 further includes a primary dispenser or dispensing assembly 112 (FIG. 2) for dispensing wash fluid into wash tub 108.

In addition, washing machine appliance 100 includes a wash basket 114 that is positioned within wash tub 108 and generally defines an opening 116 for receipt of articles for washing. More specifically, wash basket 114 is rotatably mounted within wash tub 108 such that it is rotatable about an axis of rotation A. According to the illustrated embodiment, the axis of rotation A is substantially parallel to the vertical direction V. In this regard, washing machine appliance 100 is generally referred to as a "vertical axis" or "top load" washing machine appliance 100. However, it should be appreciated that aspects of the present subject matter may be used within the context of a horizontal axis or front load washing machine appliance as well.

As illustrated, cabinet 102 of washing machine appliance 100 has a top panel 118. Top panel 118 defines an opening (FIG. 2) that coincides with opening 116 of wash basket 114 to permit a user access to wash basket 114. Washing machine appliance 100 further includes a door 120 which is rotatably mounted to top panel 118 to permit selective access to opening 116. In particular, door 120 selectively rotates between the closed position (as shown in FIGS. 1 and 3) and the open position (as shown in FIG. 2). In the closed position, door 120 inhibits access to wash basket 114. Conversely, in the open position, a user can access wash basket 114. A window 122 in door 120 permits viewing of wash basket 114 when door 120 is in the closed position, e.g., during operation of washing machine appliance 100. Door 120 also includes a handle 124 that, e.g., a user may pull and/or lift when opening and closing door 120. Further, although door 120 is illustrated as mounted to top panel 118, door 120 may alternatively be mounted to cabinet 102 or any other suitable support.

As best shown in FIGS. 2 and 3, wash basket 114 further defines a plurality of perforations 126 to facilitate fluid communication between an interior of wash basket 114 and wash tub 108. In this regard, wash basket 114 is spaced apart from wash tub 108 to define a space for wash fluid to escape wash chamber 110. During a spin cycle, wash fluid within articles of clothing and within wash chamber 110 is urged through perforations 126 wherein it may collect in a sump 128 defined by wash tub 108. Washing machine appliance 100 further includes a pump assembly 130 (FIG. 3) that is located beneath wash tub 108 and wash basket 114 for gravity assisted flow when draining wash tub 108.

An impeller or agitation element 132 (FIG. 3), such as a vane agitator, impeller, auger, oscillatory basket mechanism, or some combination thereof is disposed in wash basket 114 to impart an oscillatory motion to articles and liquid in wash basket 114. More specifically, agitation element 132 extends into wash basket 114 and assists agitation of articles disposed within wash basket 114 during operation of washing machine appliance 100, e.g., to facilitate improved cleaning. In different embodiments, agitation element 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitation element 132 and wash basket 114 are oriented to rotate about axis of rotation A (which is substantially parallel to vertical direction V).

As best illustrated in FIG. 3, washing machine appliance 100 includes a drive assembly or motor assembly 138 in mechanical communication with wash basket 114 to selectively rotate wash basket 114 (e.g., during an agitation or a rinse cycle of washing machine appliance 100). In addition, motor assembly 138 may also be in mechanical communication with agitation element 132. In this manner, motor assembly 138 may be configured for selectively rotating or oscillating wash basket 114 and/or agitation element 132 during various operating cycles of washing machine appliance 100.

More specifically, motor assembly 138 may generally include one or more of a drive motor 140 and a transmission assembly 142, e.g., such as a clutch assembly, for engaging and disengaging wash basket 114 and/or agitation element 132. According to the illustrated embodiment, drive motor 140 is a brushless DC electric motor, e.g., a pancake motor. However, according to alternative embodiments, drive motor 140 may be any other suitable type or configuration of motor. For example, drive motor 140 may be an AC motor, an induction motor, a permanent magnet synchronous motor, or any other suitable type of motor. In addition, motor assembly 138 may include any other suitable number, types, and configurations of support bearings or drive mechanisms.

Referring still to FIGS. 1 through 3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, and/or other items of interest to appliance users regarding operation.

Operation of washing machine appliance 100 is controlled by a controller or processing device 156 that is operatively coupled to control panel 150 for user manipulation to select washing machine cycles and features. In response to user manipulation of control panel 150, controller 156 operates the various components of washing machine appliance 100 to execute selected machine cycles and features. According to an exemplary embodiment, controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of washing machine appliance 100 may be in communication with controller 156 via one or more signal lines or shared communication busses.

During operation of washing machine appliance 100, laundry items are loaded into wash basket 114 through opening 116, and washing operation is initiated through operator manipulation of input selectors 152. Wash basket 114 is filled with water and detergent and/or other fluid additives via primary dispenser 112. One or more valves can be controlled by washing machine appliance 100 to provide for filling wash tub 108 and wash basket 114 to the appropriate level for the amount of articles being washed and/or rinsed. By way of example for a wash mode, once wash basket 114 is properly filled with fluid, the contents of wash basket 114 can be agitated (e.g., with agitation element 132 as discussed previously) for washing of laundry items in wash basket 114.

Referring again to FIGS. 2 and 3, dispensing assembly 112 of washing machine appliance 100 will be described in more detail. As explained briefly above, dispensing assembly 112 may generally be configured to dispense wash fluid to facilitate one or more operating cycles or phases of an operating cycle (e.g., such as a wash cycle or a rinse cycle). The terms "wash fluid" and the like may be used herein to generally refer to a liquid used for washing and/or rinsing clothing or other articles. For example, the wash fluid is typically made up of water that may include other additives such as detergent, fabric softener, bleach, or other suitable treatments (including combinations thereof). More specifically, the wash fluid for a wash cycle may be a mixture of water, detergent, and/or other additives, while the wash fluid for a rinse cycle may be water only.

As best shown schematically in FIG. 3, dispensing assembly 112 may generally include a bulk storage tank or bulk reservoir 158 and a dispenser box 160. More specifically, bulk reservoir 158 may be positioned under top panel 118 and defines an additive reservoir for receiving and storing wash additive. More specifically, according to the illustrated embodiment, bulk reservoir 158 may contain a bulk volume of wash additive (such as detergent or other suitable wash additives) that is sufficient for a plurality of wash cycles of washing machine appliance 100, such as no less than twenty wash cycles, no less than fifty wash cycles, etc. As a particular example, bulk reservoir 158 is configured for containing no less than twenty fluid ounces, no less than three-quarters of a gallon, or about one gallon of wash additive.

Referring still to FIG. 3, washing machine appliance 100 may further include a one or more tank level sensors 161 that are generally configured for measuring a level or levels of wash additive within bulk reservoir 158. In this regard, for example, tank level sensors 161 may be positioned at multiple heights within bulk reservoir 158 and may be triggered when the level of wash additive falls below a predetermined height (e.g., associated with a specific wash additive volume). For example, washing machine appliance 100 may include tank level sensors 161 that indicate when the level of wash additive is full, low, empty, etc. It should be appreciated that tank level sensors 161 may utilize any suitable technology for measuring fluid levels, e.g., such as float sensors, conductivity sensors, capacitive sensors, mechanical switches, or any other suitable device or technology.

As will be described in detail below, dispensing assembly 112 may include features for drawing wash additive from bulk reservoir 158 and mixing it with water prior to directing the mixture into wash tub 108 to facilitate a cleaning operation. By contrast, dispensing assembly 112 is also capable of dispensing water only. Thus, dispensing assembly 112 may automatically dispense the desired amount of water with or without a desired amount of wash additive such that a user can avoid filling dispenser box 160 with detergent before each operation of washing machine appliance 100.

For example, as best shown in FIG. 3, washing machine appliance 100 includes an aspirator assembly 162, which is a Venturi-based dispensing system that uses a flow of water to create suction within a Venturi tube to draw in wash additive from bulk reservoir 158 which mixes with the water and is dispensed into wash tub 108 as a concentrated wash fluid preferably having a target volume of wash additive. After the target volume of wash additive is dispensed into wash tub 108, additional water may be provided into wash tub 108 as needed to fill to the desired wash volume. It should be appreciated that the target volume may be preprogrammed in controller 156 according to the selected operating cycle or parameters, may be set by a user, or may be determined in any other suitable manner.

As illustrated, aspirator assembly 162 includes a Venturi pump 164 that is fluidly coupled to both a water supply conduit 166 and a suction line 168. As illustrated, water supply conduit 166 may provide fluid communication between a water supply source 170 (such as a municipal water supply) and a water inlet of Venturi pump 164. In addition, washing machine appliance 100 includes a water fill valve or water control valve 172 which is operably coupled to water supply conduit 166 and is communicatively coupled to controller 156. In this manner, controller 156 may regulate the operation of water control valve 172 to regulate the amount of water that passes through aspirator assembly 162 and into wash tub 108.

In addition, suction line 168 may provide fluid communication between bulk reservoir 158 and Venturi pump 164 (e.g., via a suction port defined on Venturi pump 164). Notably, as a flow of water is supplied through Venturi pump 164 to wash tub 108, the flowing water creates a negative pressure within suction line 168. This negative pressure may draw in wash additive from bulk reservoir 158. When certain conditions exist, the amount of wash additive dispensed is roughly proportional to the amount of time water is flowing through Venturi pump 164.

Referring still to FIG. 3, aspirator assembly 162 may further include a suction valve 174 that is operably coupled to suction line 168 to control the flow of wash additive through suction line 168 when desired. For example, suction valve 174 may be a solenoid valve that is communicatively coupled with controller 156. Controller 156 may selectively open and close suction valve 174 to allow wash additive to flow from bulk reservoir 158 through additive suction valve 174. For example, during a rinse cycle where only water is desired, suction valve 174 may be closed to prevent wash additive from being dispensed through suction valve 174. In some embodiments, suction valve 174 is selectively controlled based on at least one of the selected wash cycle, the soil level of the articles to be washed, and the article type. According to still other embodiments, no suction valve 174 is needed at all and alternative means for preventing the flow of wash additive may be used or other water regulating valves may be used to provide water into wash tub 108.

Washing machine appliance 100, or more particularly, dispensing assembly 112, generally includes a discharge nozzle 176 for directing a flow of wash fluid (e.g., identified herein generally by reference numeral 178) into wash chamber 108. In this regard, discharge nozzle 176 may be positioned above wash tub proximate a rear of opening 116 defined through top panel 118. Dispensing assembly 112 may be regulated by controller 156 to discharge wash fluid 178 through discharge nozzle 176 at the desired flow rates, volumes, and/or detergent concentrations to facilitate various operating cycles, e.g., such as wash or rinse cycles.

Although water supply conduit 166, water supply source 170, discharge nozzle 176, and water control valve 172 are all described and illustrated herein in the singular form, it should be appreciated that these terms may be used herein generally to describe a supply plumbing for providing hot and/or cold water into wash chamber 110. In this regard, water supply conduit 166 may include separate conduits for receiving hot and cold water, respectively. Similarly, water supply source 170 may include both hot- and cold-water supplies regulated by dedicated valves. In addition, washing machine appliance 100 may include one or more pressure sensors (not shown) for detecting the amount of water and or clothes within wash tub 108. For example, the pressure sensor may be operably coupled to a side of tub 108 for detecting the weight of wash tub 108, which controller 156 may use to determine a volume of water in wash chamber 110 and a subwasher load weight.

After wash tub 108 is filled and the agitation phase of the wash cycle is completed, wash basket 114 can be drained, e.g., by drain pump assembly 130. Laundry articles can then be rinsed by again adding fluid to wash basket 114 depending on the specifics of the cleaning cycle selected by a user. The impeller or agitation element 132 may again provide agitation within wash basket 114. One or more spin cycles may also be used as part of the cleaning process. In particular, a spin cycle may be applied after the wash cycle and/or after the rinse cycle in order to wring wash fluid from the articles being washed. During a spin cycle, wash basket 114 is rotated at relatively high speeds to help wring fluid from the laundry articles through perforations 126. During or prior to the spin cycle, drain pump assembly 138 may operate to discharge wash fluid from wash tub 108, e.g., to an external drain. After articles disposed in wash basket 114 are cleaned and/or washed, the user can remove the articles from wash basket 114, e.g., by reaching into wash basket 114 through opening 116.

Referring now specifically to FIGS. 2 and 3, washing machine appliance 100 may further include a camera assembly 180 that is generally positioned and configured for obtaining images within wash chamber 110 of washing machine appliance 100. Specifically, according to the illustrated embodiment, camera assembly 180 may include a camera 182 mounted to an underside of door 120 of washing machine appliance 100. In this manner, when door 120 is in the closed position, camera 182 may be positioned over wash chamber 110 and may be oriented for obtaining images within wash chamber 110. Specifically, camera 182 is mounted such that it faces toward a bottom side of wash tub 108. In this manner, camera 182 can take unobstructed images or video of an inside of wash chamber 110, e.g., including images of wash basket 114 and discharge nozzle 176.

It should be appreciated that camera assembly 180 may include any suitable number, type, size, and configuration of camera(s) 182 for obtaining images of wash chamber 110. In general, cameras 182 may include a lens 184 that is constructed from a clear hydrophobic material or which may otherwise be positioned behind a hydrophobic clear lens. So positioned, camera assembly 180 may obtain one or more images or videos within wash chamber 110, as described in more detail below. It should be appreciated that other locations for mounting camera assembly 180 are possible, such as below or adjacent a discharge nozzle 176 of washing machine appliance 100.

Referring still to FIGS. 2 through 3, washing machine appliance 100 may further include a tub light 186 that is positioned within cabinet 102 or wash chamber 110 for selectively illuminating wash chamber 110 and the load of clothes positioned therein. Specifically, as shown in FIG. 2, tub light 186 may be integrated into camera assembly 180 and may be positioned immediately adjacent camera 182. According to still other embodiments, tub light 186 may be positioned at any other suitable location within cabinet 102. It should be appreciated that according to alternative embodiments, washing machine appliance 100 may include any other camera or system of imaging devices for obtaining images of the load of clothes or the flow of wash fluid. In addition, these cameras may be positioned at any suitable location within cabinet 102, may include any suitable lighting features, and may utilize any suitable photography or imaging technology.

Notably, controller 156 of washing machine appliance 100 (or any other suitable dedicated controller) may be communicatively coupled to camera assembly 180, tub light 186, and other components of washing machine appliance 100. As explained in more detail below, controller 156 may be programmed or configured for analyzing the images obtained by camera assembly 180, e.g., in order to determine the level of water or wash fluid within wash chamber 110, the additive content of the flow of wash fluid 178, or other cycle information, and may use this information to make informed decisions regarding the operation of washing machine appliance 100.

Referring still to FIG. 1, a schematic diagram of an external communication system 190 will be described according to an exemplary embodiment of the present subject matter. In general, external communication system 190 is configured for permitting interaction, data transfer, and other communications between washing machine appliance 100 and one or more external devices. For example, this communication may be used to provide and receive operating parameters, user instructions or notifications, performance characteristics, user preferences, or any other suitable information for improved performance of washing machine appliance 100. In addition, it should be appreciated that external communication system 190 may be used to transfer data or other information to improve performance of one or more external devices or appliances and/or improve user interaction with such devices.

For example, external communication system 190 permits controller 156 of washing machine appliance 100 to communicate with a separate device external to washing machine appliance 100, referred to generally herein as an external device 192. As described in more detail below, these communications may be facilitated using a wired or wireless connection, such as via a network 194. In general, external device 192 may be any suitable device separate from washing machine appliance 100 that is configured to provide and/or receive communications, information, data, or commands from a user. In this regard, external device 192 may be, for example, a personal phone, a smartphone, a tablet, a laptop or personal computer, a wearable device, a smart home system, or another mobile or remote device.

In addition, a remote server 196 may be in communication with washing machine appliance 100 and/or external device 192 through network 194. In this regard, for example, remote server 196 may be a cloud-based server 196, and is thus located at a distant location, such as in a separate state, country, etc. According to an exemplary embodiment, external device 192 may communicate with a remote server 196 over network 194, such as the Internet, to transmit/receive data or information, provide user inputs, receive user notifications or instructions, interact with or control washing machine appliance 100, etc. In addition, external device 192 and remote server 196 may communicate with washing machine appliance 100 to communicate similar information.

In general, communication between washing machine appliance 100, external device 192, remote server 196, and/or other user devices or appliances may be carried using any type of wired or wireless connection and using any suitable type of communication network, non-limiting examples of which are provided below. For example, external device 192 may be in direct or indirect communication with washing machine appliance 100 through any suitable wired or wireless communication connections or interfaces, such as network 194. For example, network 194 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 190 is described herein according to an exemplary embodiment of the present subject matter. However, it should be appreciated that the exemplary functions and configurations of external communication system 190 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

According to example embodiments, washing machine appliance 100 may further include one or more water property sensors, e.g., identified herein as conductivity sensors 198. As best shown in FIG. 3, conductivity sensor 198 may be positioned proximate a bottom of wash tub 108, e.g., to facilitate measurement of the electrical conductivity of wash fluid that collects within wash tub 108. It should be appreciated that washing machine appliance 100 may include other conductivity sensors or systems, and that such systems may incorporate or include any suitable devices or technology for measuring the electrical conductivity of wash fluid.

While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machine appliances. In addition, aspects of the present subject matter may be utilized in a combination washer/dryer appliance.

Figure 4:
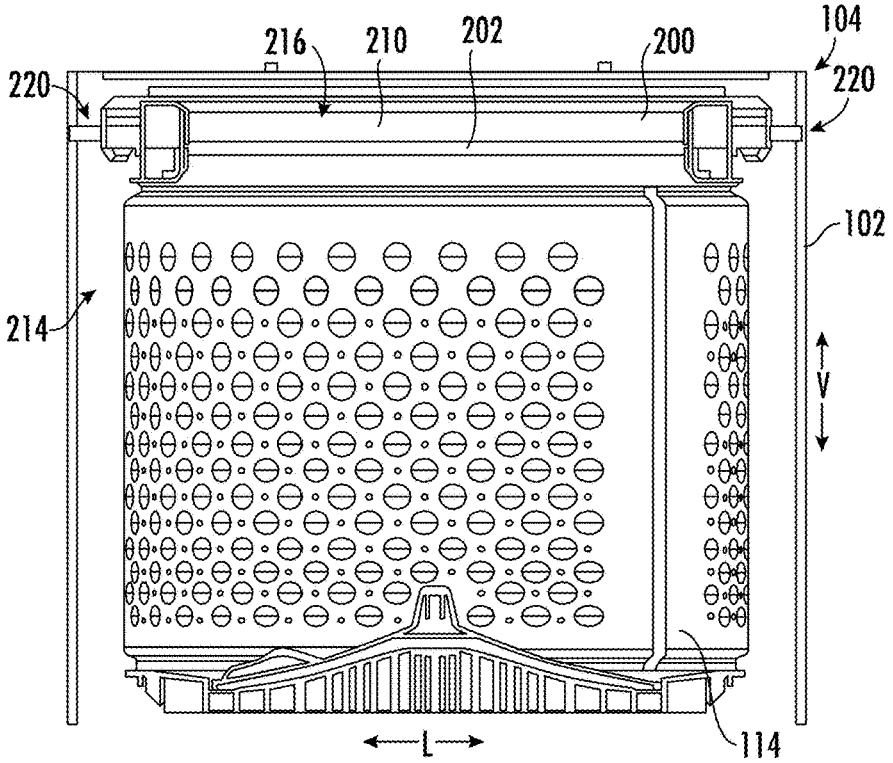
FIG. 4 provides a cross-sectional side view of a tub assembly of the example washing machine appliance of FIG. 1 in accordance with one embodiment of the present disclosure.

Referring now generally to FIGS. 4 through 12, washing machine appliance 100 may further include a tub cover 200 that is generally positioned over wash tub 108 and/or wash basket 114. In this regard, tub cover 200 may be positioned over a balancing ring 202 that is mounted directly over top of wash basket 114. In general, tub cover 200 may be configured to reduce splashing out of wash tub 108. For example, as shown in FIG. 4, tub cover 200 may include a main body 210 that may be configured for receiving a top end of the balancing ring 202 or wash basket 114. Similarly, a top end of wash tub 108 (not shown in FIGS. 4 and 5) may also be received within tub cover 200. In general, tub cover 200 does not rotate with wash basket 114 but is instead rotatably fixed or stationary relative to wash tub 108 and/or cabinet 102.

Wash tub 108, wash basket 114, balancing ring 202, and tub cover 200 may be referred to generally as a subwasher 214 of washing machine appliance 100. As explained briefly above, subwasher 214 is generally suspended within cabinet 102, and unbalanced loads may generally cause subwasher 214 to move within cabinet 102. Excessive movement of subwasher 214 may cause strikes between subwasher 214 and cabinet 102, resulting in loud noises and potential damage to components of washing machine appliance 100. Accordingly, aspects of the present subject matter are directed to structures for reducing the negative effects of such impacts.

In this regard, as illustrated in FIGS. 4 through 12, tub cover 200 may generally define a radial direction R and a circumferential direction C. In addition, main body 210 of tub cover 200 may generally define a perimeter 216 (e.g., an outermost surface of main body 210 along the radial direction R). Notably, it is the perimeter 216 of tub cover 200 that may most commonly impact cabinet 102. Accordingly, aspects of the present subject matter are generally directed to features that may be used to minimize impacts, vibration, and noise generated due to movement of subwasher 214 within cabinet 102.

For example, washing machine appliance 100 may further include one or more sound dampening assemblies 220 that are mounted to or positioned around perimeter 216 of tub cover 200 to absorb impacts between tub cover 200 and cabinet 102. Although an exemplary sound dampening assembly 220 is described below according to example embodiments, it should be appreciated that variations and modifications to the structure of sound dampening assembly 220 may be made while remaining within the scope of the present subject matter.

Figure 5:
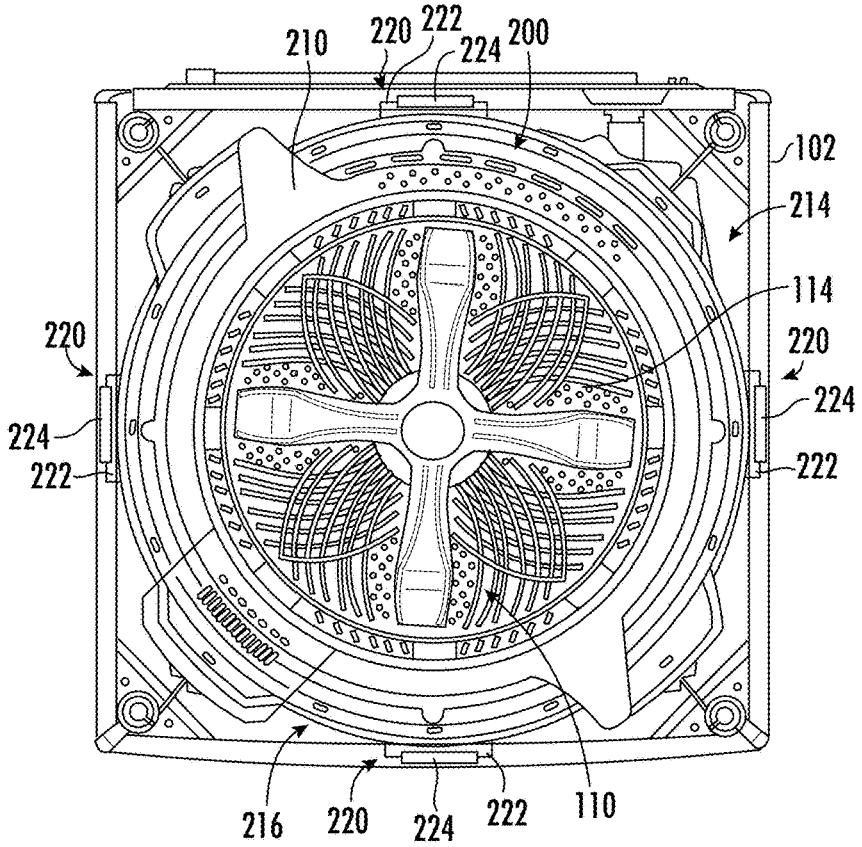
FIG. 5 provides a top view of the example washing machine appliance of FIG. 1 in accordance with one embodiment of the present disclosure.
Figure 6:
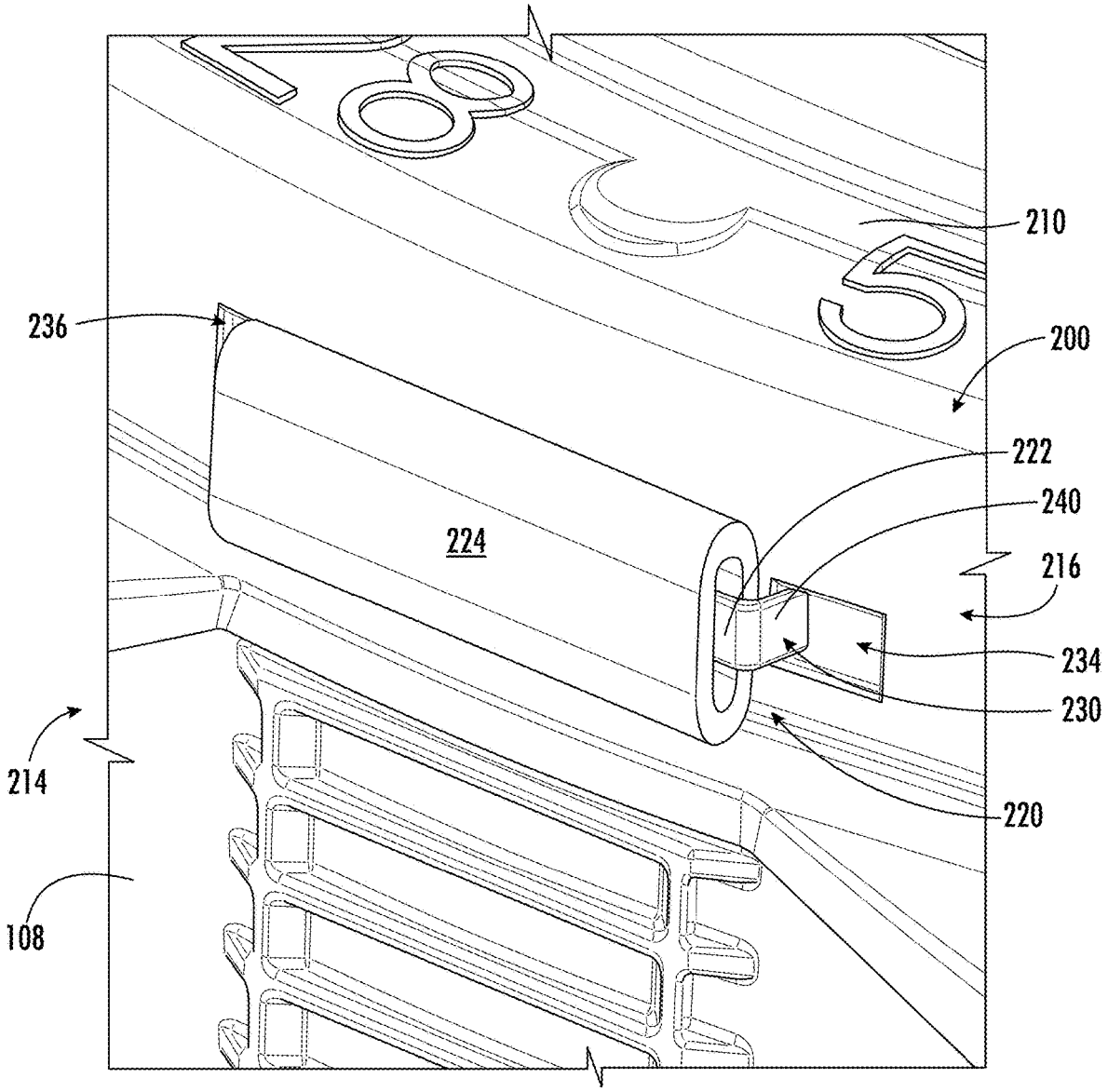
FIG. 6 provides a perspective view of a sound dampening assembly that may be used with the example tub assembly of FIG. 4 in accordance with one embodiment of the present disclosure.
Figure 7:
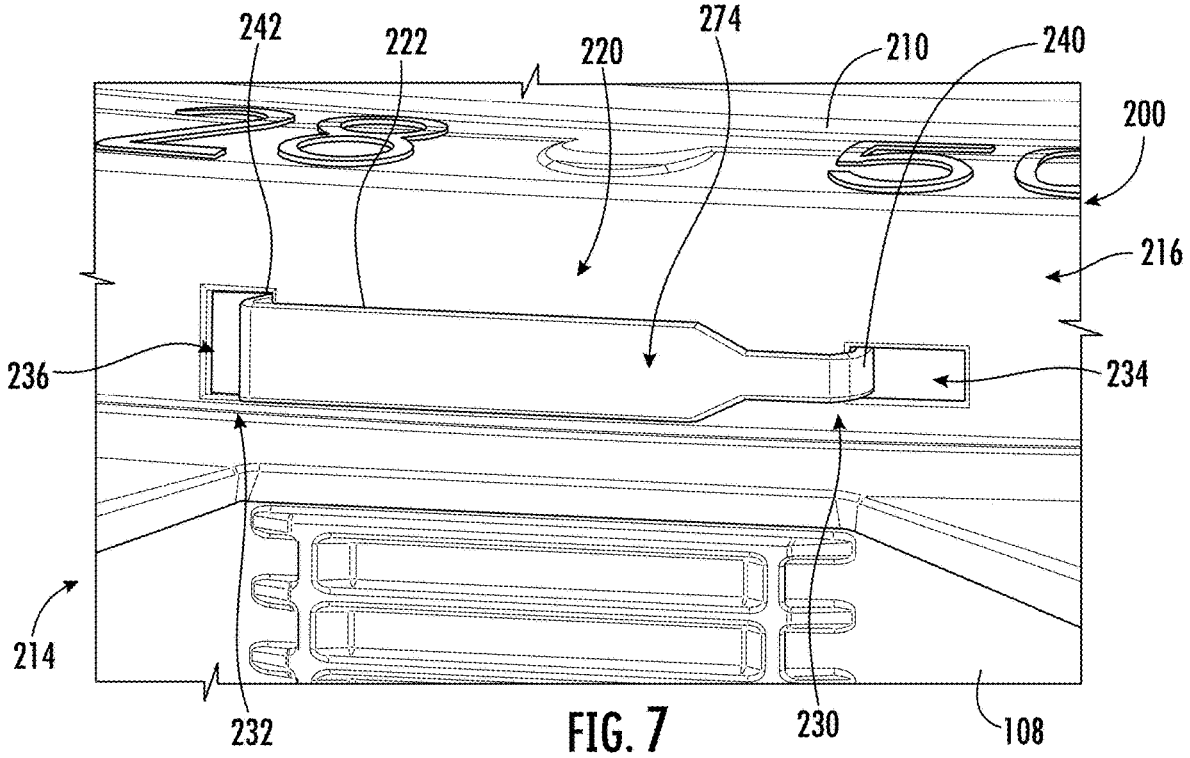
FIG. 7 provides a perspective view of the example sound dampening assembly of FIG. 6 with a dampening pad removed to reveal an extension arm according to an example embodiment of the present subject matter.
Figure 8:
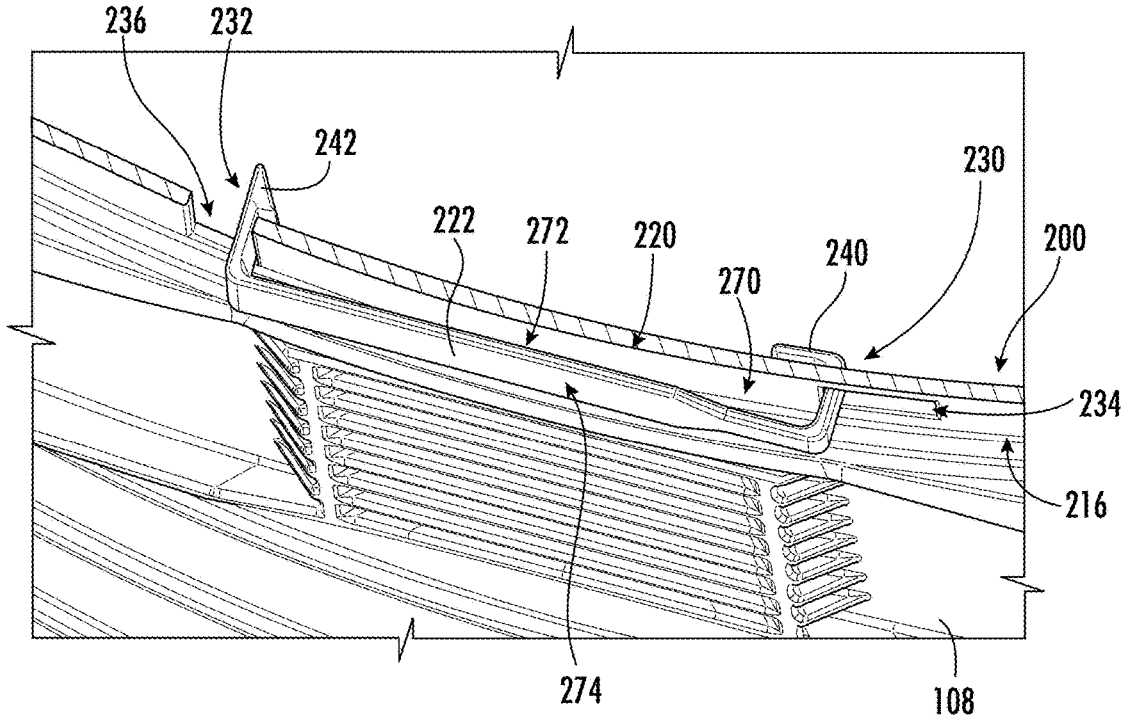
FIG. 8 provides a cross-sectional view of the example sound dampening assembly of FIG. 6 with the dampening pad removed according to an example embodiment of the present subject matter.
Figure 9:
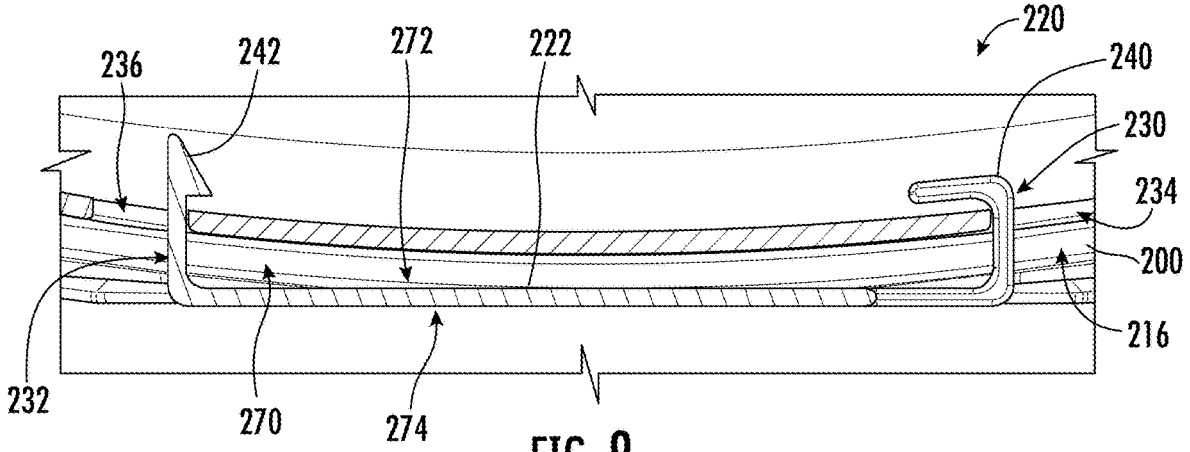
FIG. 9 provides another cross-sectional view of the example sound dampening assembly of FIG. 6 with the dampening pad removed according to an example embodiment of the present subject matter.
Figure 10:
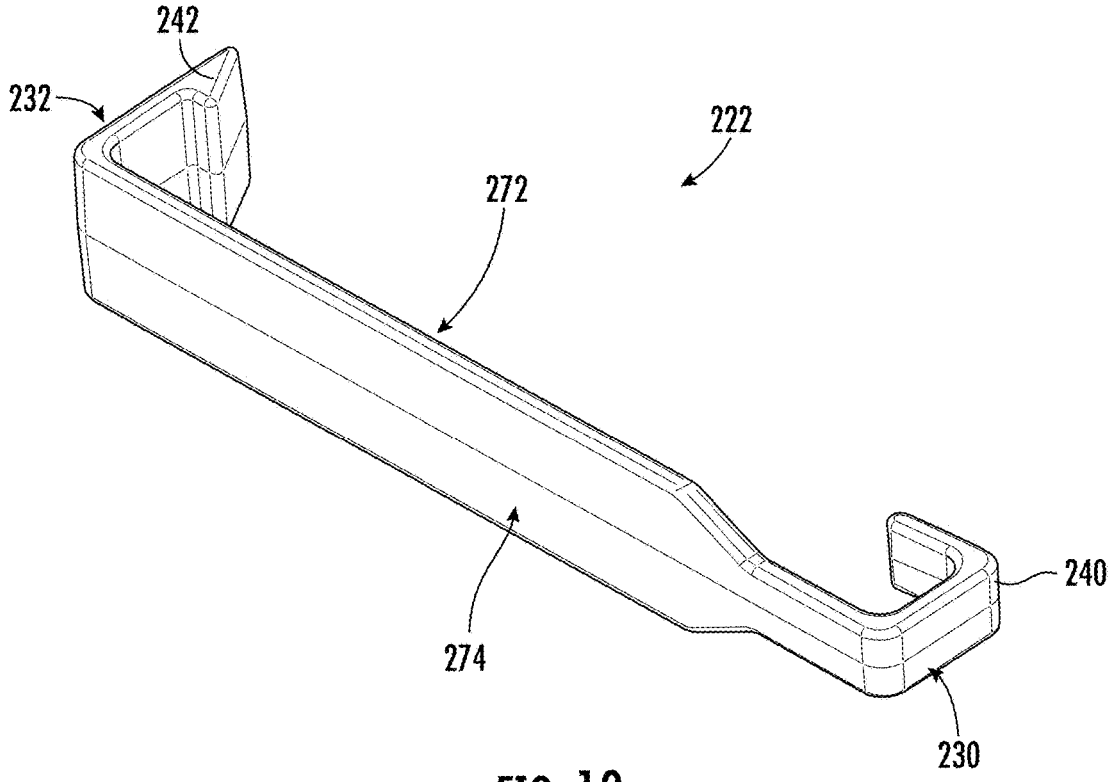
FIG. 10 provides a perspective view of the example extension arm of FIG. 7 according to an example embodiment of the present subject matter.

In addition, example sound dampening assemblies 220 are described herein at a single location on tub cover 200, it should be appreciated that any suitable number and positioning of sound dampening assemblies 220 may be used while remaining within the scope of the present subject matter. In this regard, for example, as best illustrated in FIG. 5, sound dampening assemblies 220 may generally be spaced apart on perimeter 216 of tub cover 200 along the circumferential direction C. In this regard, according to the illustrated embodiment, washing machine appliance 100 includes four sound dampening assemblies 220, each being spaced in a quadrant of perimeter 216. More specifically, as illustrated, sound dampening assemblies 220 are positioned at a front end, a back end, a left end, and a right end of tub cover 200. In this manner, sound dampening assemblies 220 may be configured for absorbing impacts with a front panel, a back panel, a left panel, and a right panel of cabinet 102, respectively.

In addition, it should be appreciated that sound dampening assemblies 220 may cover a portion of perimeter 216 where cabinet impacts are likely. For example, according to the illustrated embodiment, sound dampening assemblies 220 may cover greater than 20% of perimeter 216 of tub cover 200. According to still other embodiments, sound dampening assemblies 220 may cover greater than 40%, greater than 50%, or greater of perimeter 216 of tub cover 200. Other suitable sizing, positioning, and configurations of sound dampening assemblies 220 may be used while remaining within the scope of the present subject matter.

According to an example embodiment, sound dampening assembly includes an extension arm 222 that extends from perimeter 216 of tub cover 200. In this regard, extension arm 222 may generally be any suitable structure that extends from, is attached to, or is positioned adjacent tub cover 200. As explained in more detail below, extension arm 222 may be formed as a part of tub cover 200 or may be a separate component that is attached to tub cover 200. According to still other embodiments, extension arm 222 may be mounted within washing machine appliance 100 between tub cover 200 and cabinet 102 in any other suitable manner. As illustrated, sound dampening assembly 220 further includes a dampening pad 224 that is positioned on extension arm 222 to absorb impacts between tub cover 200 and cabinet 102. Although example extension arms 222 and dampening pads 224 are described below, it should be appreciated that variations and modifications may be made while remaining within the scope of the present subject matter.

It should be appreciated that various features of tub cover 200 may be formed from any suitably rigid material. For example, according to exemplary embodiments, tub cover 200 and extension arm 222 be formed by injection molding, e.g., using a suitable plastic material, such as injection molding grade Polybutylene Terephthalate (PBT), Nylon 6, high impact polystyrene (HIPS), acrylonitrile butadiene styrene (ABS), or any other suitable blend of polymers. In this regard, tub cover 200 and extension arm 222 may be integrally molded as a single, unitary piece. Alternatively, according to the exemplary embodiment, these components may be compression molded, e.g., using sheet molding compound (SMC) thermoset plastic or other thermoplastics. According to still other embodiments, portions of tub cover 200 and extension arm 222 may be formed from any other suitable rigid material.

Referring now specifically to FIGS. 6 through 10, extension arm 222 may extend between a first end 230 and a second end 232 (e.g., within a horizontal plane). As described in more detail below, dampening pad 224 may be mounted to extension arm 222 prior to attaching extension arm 222 to tub cover 200. For example, tub cover 200 may define a first attachment aperture 234 and a second attachment aperture 236 that are spaced apart around perimeter 216 of tub cover 200 (e.g., spaced apart along the circumferential direction C). As illustrated, extension arm 222 is attached to tub cover 200 by passing first end 230 through first attachment aperture 234 and second end 232 through second attachment aperture 236.

According to an example embodiment, first end 230 defines a hook 240 and second end 232 defines a resilient clip 242 to facilitate attachment to tub cover 200. In this regard, for example, hook 240 may pass through first attachment aperture 234 where it may be secured against an edge that defines first attachment aperture 234. After dampening pad 224 is installed, second end 232 may be attached by pressing resilient clip 242 through second attachment aperture 236. For example, resilient clip 242 may flex outward or away from first end 230 as it engages tub cover 200 before passing through second attachment aperture 236, at which point resilient clip 242 snaps into place to secure extension arm 222 to tub cover 200.

According to an example embodiment, tub cover 200 and sound dampening assembly 220 may be "poka-yoked," i.e., designed to prevent improper installation of sound dampening assembly 220. For example, first attachment aperture 234 may be larger than second attachment aperture 236 and hook 240 of first end 230 may be sized to pass through first attachment aperture 234 while remaining too large to pass through second attachment aperture 236. It should be appreciated that any other suitable geometry or keyed structures may be used to ensure proper installation of extension arm 222 and sound dampening assembly 200.

Figure 11:
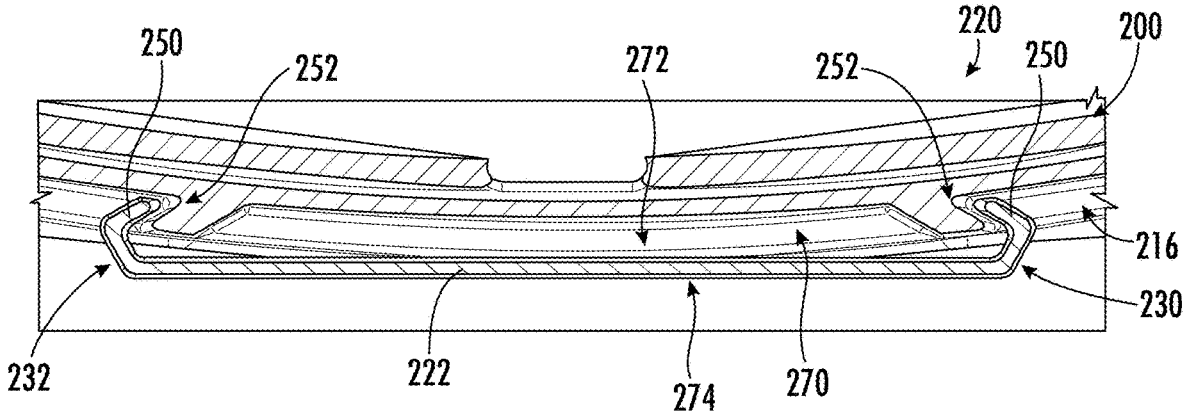
FIG. 11 provides a cross-sectional view of a sound dampening assembly of according to another example embodiment of the present subject matter.

Referring now briefly to FIG. 11, a sound dampening assembly 200 using a different attachment method is illustrated according to an example embodiment. Due to the similarity between constructions, like references may be used to refer to the same or similar parts. As illustrated, first end 230 and second end 232 of extension arm 222 each define retention features 250 and tub cover 200 defines complementary recesses 252 or receiving structures for receiving retention features 252 to attach extension arm 222 to tub cover 200. For example, according to the illustrated embodiment, retention features 250 and complementary recesses may engage each other to prevent relative movement between extension arm 222 and tub cover 200 (e.g., such as a dovetail or locking rail engagement). According to an example embodiment, extension arm 222 may slide onto tub cover 200 along the vertical direction V but movement within a horizontal plane may be restricted.

Figure 12:
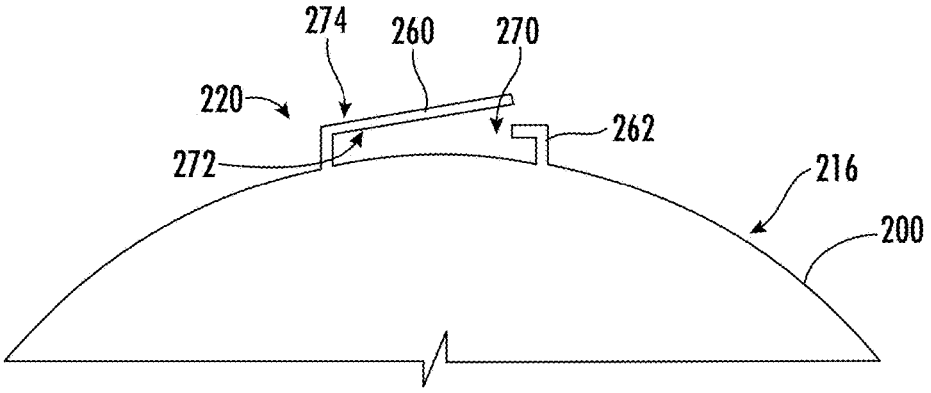
FIG. 12 provides a cross-sectional view of a sound dampening assembly of according to another example embodiment of the present subject matter.

Referring now briefly to FIG. 12, according to an alternative embodiment, extension arm 222 may be an injection molded extension of tub cover 200. In this regard, instead of molding or manufacturing tub cover 200 to include features for attaching extension arm 222, tub cover 200 may instead be formed with such an extension. For example, tub cover 200 may include a first arm 260 and a second arm 262 that are formed as part of tub cover 200 and are cantilevered from perimeter 216. After dampening pad 224 is installed, first arm 260 and/or second arm 262 may be bent or flexed to engage each other, e.g., where they may be retained through an interference fit, snap engagement, etc. According to still other embodiments, a single integral extension arm 222 may be used and may be attached to tub cover 200 in any suitable manner.

According to an example embodiment, a gap 270 may be defined between extension arm 222 and perimeter 216 of tub cover 200 when extension arm 222 is in an installed position. In this regard, for example, dampening pad 224 may be positioned through gap 270 such that it contacts both an inner surface 272 and an outer surface 274 of extension arm 222. According to an example embodiment, dampening pad 224 may be a sleeve that slides onto extension arm 222 and extends around an entirety of extension arm 222. Dampening pad 224 may be attached using an adhesive or may be floating on extension arm 222. It should be appreciated that dampening pad 224 may be formed from any suitable material that facilitates the reduction in impacts, vibration, noise, etc. For example, dampening pad 224 may be constructed from at least one of a foam, a felt, a rubber, a neoprene, or a resilient polymer material.

As explained herein, aspects of the present subject matter are generally directed to an external component for a top load washing machine to reduce noise during the spin cycle. It attaches easily to the tub cover and accommodates sound-dampening materials. Two holes may be created on the tub cover's side, into which a separate part with a hook and snap arm may be inserted. This part secures the position and allows for the insertion of sound-dampening material between the clip and tub cover. During operation, the material absorbs impact, significantly reducing noise without the need for expensive adhesive-backed foam. Overall, the component offers a simple, cost-effective solution for quieter washing machine operation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:
- a cabinet;
- a wash tub positioned within the cabinet;
- a wash basket rotatably mounted within the wash tub and defining a wash chamber configured for receiving a load of clothes;
- a tub cover positioned over the wash tub, the tub cover having a main body defining a perimeter, wherein the tub cover defines a first attachment aperture and a second attachment aperture; and
- a sound dampening assembly operably coupled to the tub cover, the sound dampening assembly comprising:
  - an extension arm that extends from the perimeter of the tub cover, wherein the extension arm extends between a first end and a second end and is attached to the tub cover by passing the first end through the first attachment aperture and the second end through the second attachment aperture; and
  - a dampening pad positioned on the extension arm to absorb impacts between the tub cover and the cabinet.

2. The washing machine appliance of claim 1, wherein the first end defines a hook and the second end defines a resilient clip.

3. The washing machine appliance of claim 1, wherein the first attachment aperture is larger than the second attachment aperture, and wherein the first end of the extension arm is sized to pass through the first attachment aperture but not the second attachment aperture.

4. The washing machine appliance of claim 1, wherein the extension arm extends between a first end and a second end, the first end and the second end each defining retention features, and wherein the tub cover defines complementary recesses for receiving the retention features to attach the extension arm to the tub cover.

5. The washing machine appliance of claim 4, wherein the retention features are configured to slide into the complementary recesses along a vertical direction.

6. The washing machine appliance of claim 1, wherein the extension arm is injection molded as an extension of the tub cover.

7. The washing machine appliance of claim 1, wherein a gap is defined between the extension arm and the perimeter of the tub cover when the extension arm is in an installed position.

8. The washing machine appliance of claim 1, wherein the dampening pad is at least one of a foam, a felt, a rubber, a neoprene, or a resilient polymer material.

9. The washing machine appliance of claim 1, wherein the dampening pad is attached using an adhesive.

10. The washing machine appliance of claim 1, wherein the dampening pad is attached to both an inner surface and an outer surface of the extension arm.

11. The washing machine appliance of claim 1, wherein the dampening pad is a sleeve that slides onto the extension arm and extends around an entirety of the extension arm.

12. The washing machine appliance of claim 1, wherein the extension arm is a first extension arm and the dampening pad is a first dampening pad, the sound dampening assembly further comprising:

a second extension arm that extends from the perimeter of the tub cover; and a second dampening pad positioned on the second extension arm to absorb impacts between the tub cover and the cabinet.

13. The washing machine appliance of claim 12, wherein the second extension arm is spaced apart 180 degrees from the first extension arm along the perimeter of the tub cover.

14. The washing machine appliance of claim 1, wherein the washing machine appliance is a vertical axis washing machine.

15. A sound dampening assembly for a tub cover of a washing machine appliance, wherein the tub cover defines a first attachment aperture and a second attachment aperture, the sound dampening assembly comprising:

an extension arm that extends from a perimeter of the tub cover, wherein the extension arm extends between a first end and a second end and is attached to the tub cover by passing the first end through the first attachment aperture and the second end through the second attachment aperture; and a dampening pad positioned on the extension arm to absorb impacts between the tub cover and a cabinet of the washing machine appliance.

16. The sound dampening assembly of claim 15, wherein the first end defines a hook and the second end defines a resilient clip, the first attachment aperture is larger than the second attachment aperture, and wherein the first end of the extension arm is sized to pass through the first attachment aperture but not the second attachment aperture.

17. The sound dampening assembly of claim 15, wherein the dampening pad is at least one of a foam, a felt, a rubber, a neoprene, or a resilient polymer material.

18. The sound dampening assembly of claim 15, wherein the dampening pad is a sleeve that slides onto the extension arm and extends around an entirety of the extension arm.

* * * * *